US009484143B2

(12) United States Patent
Nguyen et al.

(10) Patent No.: US 9,484,143 B2
(45) Date of Patent: Nov. 1, 2016

(54) INDUCTION COMPONENT

(71) Applicant: Wuerth Elektronik eiSos GmbH & Co. KG, Waldenburg (DE)

(72) Inventors: Anh-Nguyen Nguyen, Darmstadt (DE); Tim Muskat, Crailsheim (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 0 days.

(21) Appl. No.: 14/130,826

(22) PCT Filed: Jun. 18, 2013

(86) PCT No.: PCT/EP2013/062565

§ 371 (c)(1),
(2) Date: Jan. 3, 2014

(87) PCT Pub. No.: WO2014/111172

PCT Pub. Date: Jul. 24, 2014

(65) Prior Publication Data

US 2015/0310983 A1 Oct. 29, 2015

(30) Foreign Application Priority Data

Jan. 17, 2013 (DE) ..... 10 2013 200 696

(51) Int. Cl.

| | |
|---|---|
| ***H01F 27/02*** | (2006.01) |
| ***H01F 17/04*** | (2006.01) |
| ***H01F 27/06*** | (2006.01) |
| ***H01F 27/28*** | (2006.01) |
| ***H01F 3/14*** | (2006.01) |
| ***H01F 27/26*** | (2006.01) |
| ***H01F 27/29*** | (2006.01) |
| ***H01F 27/30*** | (2006.01) |
| ***H01F 27/24*** | (2006.01) |

(Continued)

(52) U.S. Cl.

CPC ..... *H01F 27/2823* (2013.01); *H01F 3/14* (2013.01); *H01F 17/045* (2013.01); *H01F 27/02* (2013.01); *H01F 27/24* (2013.01); *H01F 27/266* (2013.01); *H01F 27/292* (2013.01); *H01F 27/306* (2013.01); *H01F 41/0206* (2013.01); *H01F 41/06* (2013.01)

(58) Field of Classification Search

USPC ..... 336/90

See application file for complete search history.

(56) References Cited

U.S. PATENT DOCUMENTS

| | | | |
|---|---|---|---|
| 3,394,362 | A | 7/1968 | Gooch |
| 3,711,806 | A | 1/1973 | Flentge |
| 4,419,647 | A | 12/1983 | Herzog |

(Continued)

FOREIGN PATENT DOCUMENTS

| | | | |
|---|---|---|---|
| DE | 33 25 905 | A1 | 1/1985 |
| DE | 101 31 739 | A1 | 1/2003 |

(Continued)

*Primary Examiner* — Mangtin Lian
*Assistant Examiner* — Ronald Hinson
(74) *Attorney, Agent, or Firm* — Boyle Fredrickson, S.C.

(57) ABSTRACT

An induction component contains, in a housing, a coil, which has a coil core with two end surfaces and a coil winding. The housing consists of a housing base, in turn consisting of plastic, and a hood-like upper part connected thereto. A holder, in which the coil is held non-displaceably in the direction of its longitudinal axis, is arranged on the housing base. It is thus ensured that the air gaps to the right and left between the end surfaces of the coil core and the inner face of the housing upper part are constant.

10 Claims, 4 Drawing Sheets

(51) Int. Cl.
*H01F 41/02* (2006.01)
*H01F 41/06* (2016.01)

(56) References Cited

U.S. PATENT DOCUMENTS

| | | | | |
|---|---|---|---|---|
| 4,565,988 | A | 1/1986 | Moura et al. | |
| 5,745,021 | A | 4/1998 | Miyoshi et al. | |
| 7,190,249 | B2 | 3/2007 | Maekawa et al. | |
| 7,382,630 | B2 | 6/2008 | Lorenzen | |
| 7,961,070 | B2 | 6/2011 | Suzuki et al. | |
| 8,102,228 | B2 | 1/2012 | Okamoto | |
| 2004/0041674 | A1 | 3/2004 | Dixon | |
| 2006/0012457 | A1 | 1/2006 | Reppe et al. | |
| 2008/0284340 | A1* | 11/2008 | Varga | H01F 27/2828 315/82 |
| 2009/0115551 | A1* | 5/2009 | Kobayashi | H01F 17/045 333/185 |
| 2010/0007451 | A1* | 1/2010 | Yan | H01F 17/043 336/90 |
| 2012/0139684 | A1 | 6/2012 | Kobayashi et al. | |
| 2012/0313740 | A1 | 12/2012 | Inaba et al. | |

FOREIGN PATENT DOCUMENTS

| | | | |
|---|---|---|---|
| DE | 10 2007 063 170 | A1 | 6/2009 |
| DE | 10 2011 079 667 | A1 | 1/2013 |
| EP | 1 349 185 | A1 | 2/2003 |
| GB | 575719 | A | 3/1946 |
| GB | 946351 | A | 1/1964 |
| JP | H05217752 | A | 8/1993 |
| JP | 54-41302 | A | 6/2008 |
| JP | 2008-279418 | A | 11/2008 |
| JP | 2009-117632 | A | 5/2009 |
| JP | 05121238 | B2 | 1/2013 |

* cited by examiner

INDUCTION COMPONENT

The invention relates to an induction component comprising a coil, which has a coil winding and a coil core, and also comprising a housing which forms a casing of the coil and has a housing lower part.

Induction components of this type are known. Here, for the properties of the induction component, it is important that an air gap between the coil core and casing is observed in a precise manner.

With a known induction component, the coil core, which has a flange at each of its two ends, and the casing are arranged in an outer plastic housing, which has positioning means both for the coil core and for the casing. An accurate positioning between the two parts of the coil can thus be produced and the observance of an air gap ensured (DE 10 2007 063 170 A1).

The object of the invention is to create an induction component that is suitable in particular for automatic installation.

To achieve this object, the invention proposes an induction component having the features specified in claim 1. Refinements of the invention are disclosed by dependent claims.

The induction component, within the housing, thus contains a holder for the coil core. The holder is formed such that the coil core is held non-displaceably at least in its own longitudinal direction. It is thus ensured that the gap between the end surfaces of the core of the coil and the adjacent parts of the inner face of the housing is kept constant.

The holder arranged within the housing forming the casing renders superfluous an outer housing serving only for positioning.

In a refinement of the invention, the holder, for each end of the coil core, may have a bearing block with a bearing rest for the respective end region of the coil core. An engagement at the end regions of the coil core is expedient, since the middle region of the coil core then remains free for the winding of the coil.

In a further embodiment of the invention, the bearing rest of the bearing block has an upwardly open cavity. This cavity preferably has a curvature, which corresponds to the diameter of the coil core. The coil core is thus arranged in this cavity so as also to be secured against a displacement transverse to the longitudinal axis.

In accordance with a further feature of the invention, the bearing block, at the end arranged closer to the inner face of the wall of the housing, may have a transverse rib, which runs parallel to the wall of the housing and therefore perpendicular to the end surface of the coil core and against which this end surface comes to rest when the coil core is inserted into its holder. Here, the transverse rib only needs to engage a part of the end surface, since this is completely sufficient for axial fixing. The majority of the end surface of the coil core may thus remain free, such that a genuine air gap is formed between the end surface and the housing.

If, for certain reasons, it is desirable for no air gap to be provided, but a gap filled by the material of the transverse rib, this can also be achieved by an appropriate size of the transverse rib.

In another refinement of the invention, the bearing rest may be conical. The conicity can be used to center the coil core. In particular, the conicity of the bearing rest may correspond to a bevel provided at the end of the coil core.

In a further embodiment of the invention, the outer face of the bearing block may bear in a planar manner against the inner face of the housing.

The thickness of the transverse rib measured in the axial direction of the coil core may correspond to the dimensions of the air gap.

In a refinement, the invention proposes assembling the housing from a hood-like upper part and a base. Here, the upper part may have a cuboid shape in particular.

In accordance with the invention, the holder for the coil core may be arranged on the base, in particular integrally formed on the base. The assembly of the induction component can thus be particularly simple, since the coil with core is firstly inserted into the holder of the base of the housing, before the upper part is then fitted onto the base and connected thereto.

In accordance with the invention, the housing upper part may consist of magnetically conductive material, wherein the housing upper part is preferably formed in one piece.

The base, which may also be used for attachment of the holder for the coil core, preferably consists of non-conductive material, in particular plastic.

The housing, and therefore the induction component, is to be secured using SMD technology. The contact elements provided externally on the housing base of the housing are connected to electrodes provided inside the housing or are formed integrally with said electrodes. The ends of the coil winding are attached, in particular welded, to the electrodes inside the housing.

It has proven to be expedient to arrange the electrodes parallel to the walls of the housing, wherein, in particular, they have a flat contact surface for the end region of the coil winding. Here, the connection is preferably made to the lateral surfaces of the ends of the wire winding. A large connection surface is thus available, which is also resistant to greater forces, and therefore a stable connection is provided between the coil winding and the contact surfaces on the outer face of the induction component.

For particularly simple and expedient installation, the base of the housing may have a rectangular shape, wherein the corners of the rectangle are chamfered. Accordingly, the housing upper part, on its end edge at the corners, may have protrusions which are complementary to the chamfered corners of the base part. In the event of assembly, the end edge of the upper part may then lie in the same plane as the outer face of the base part.

In another refinement of the invention, the base, on its upper face directed toward the inside of the housing, in the region of the chamfered corners, may have inclined surfaces falling outwardly, with which inclined surfaces of identical inclination formed on the inner face of the protrusions of the housing upper part cooperate. The two parts forming the housing are thus practically automatically aligned and centered when the housing is assembled.

The invention likewise proposes a method for installing an induction component, as has been described herein. Here, the coil is firstly wound as an air-core coil and its ends are provided with solder. The coil is then slid onto the coil core, or the coil core is slid into the coil. The coil is then placed onto the bearing blocks, wherein the end surfaces of the coil core bear against the transverse ribs. The wire ends of the coil winding are then welded to the upwardly protruding electrodes.

Glue is then injected into the housing upper part and the housing upper part is connected to the housing base. Once the glue has cured, the induction component is finished.

Further features, details and advantages of the invention will emerge from the claims and the abstract, of which the wording is incorporated by reference into the content of the description, from the following description of preferred embodiments of the invention, and with reference to the drawing, in which:

Figure 1:
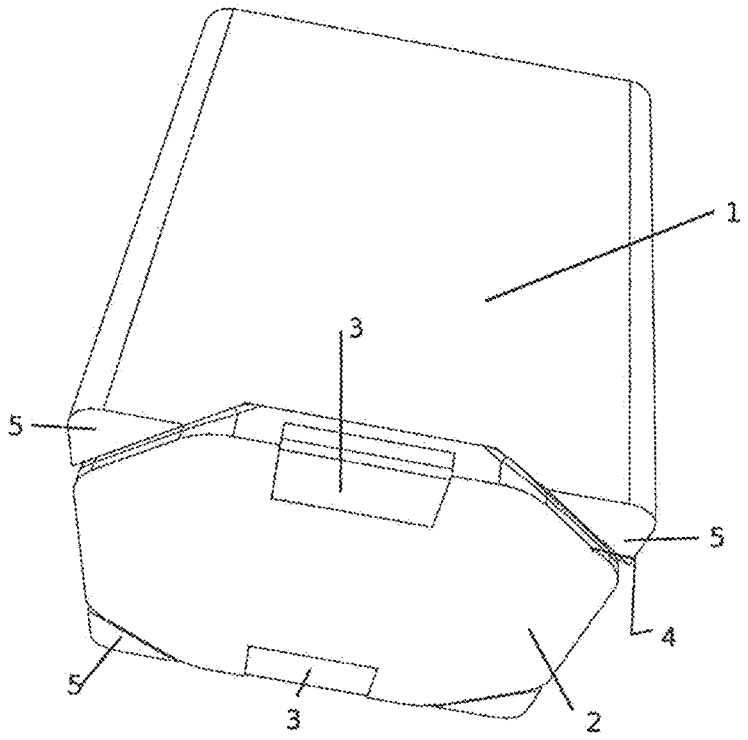
FIG. 1 shows a Perspective view from beneath a finished induction component according to the invention.

FIG. 1 shows a perspective view from beneath an induction component according to the invention. The induction component contains a housing having a hood like upper part 1, which approximately has the shape of a cuboid. The cuboid is completely closed, with the exception of the lower face. A housing base 2, which closes the open end face of the upper part 1, also belongs to the housing. On the lower face of the housing base 2, two solder pads 3 can be seen, by means of which the induction component is secured on a printed circuit board using SMD technology. The corners of the base 2 are chamfered, such that edges 4 running in an inclined manner are formed there. These side edges 4 of the base running at an incline correspond to protrusions 5 on the end face of the housing upper part 1. The lower face of the protrusions 5 thus lies in the same plane as the lower face of the base 2. In the region of the sides of the base 2, the end edge of the housing upper part 1 rests on the upper face of the housing base 2.

Figure 3:
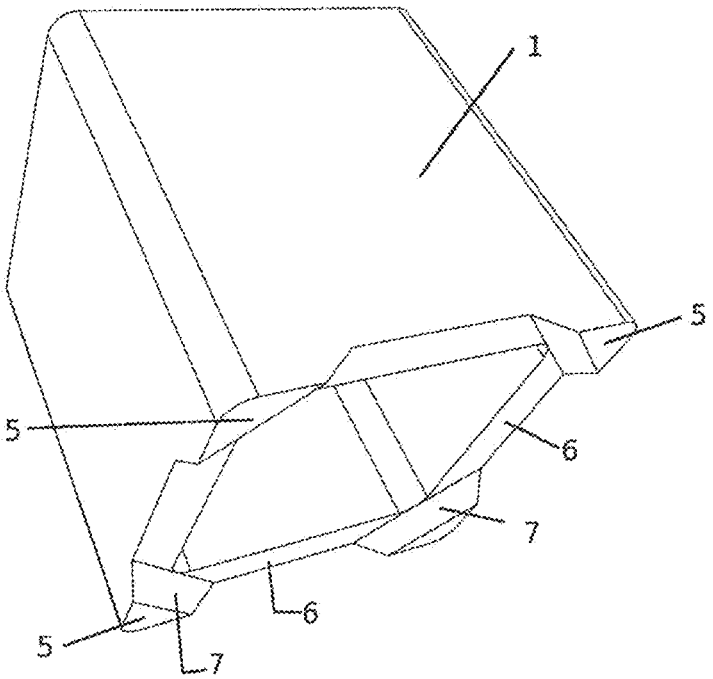
FIG. 3 shows a perspective view of the housing upper part diagonally from beneath.

The open side of the housing upper part 1 is also clear from FIG. 3, to which reference is now made. Here, it can be seen in particular that the protrusions 5 at the corners of the open side of the housing upper part 1 actually protrude with respect to the end edge 6 of the housing upper part 1. The end edge 6 lies between the protrusions 5 in one plane. In the assembled state, the end edge 6 lies between the protrusions on the upper face of the housing base 2. The inwardly directed side surfaces 7 of the protrusions 5 run at an incline in planes that converge in the direction of the closed side opposite the open side of the housing upper part 1.

Figure 2:
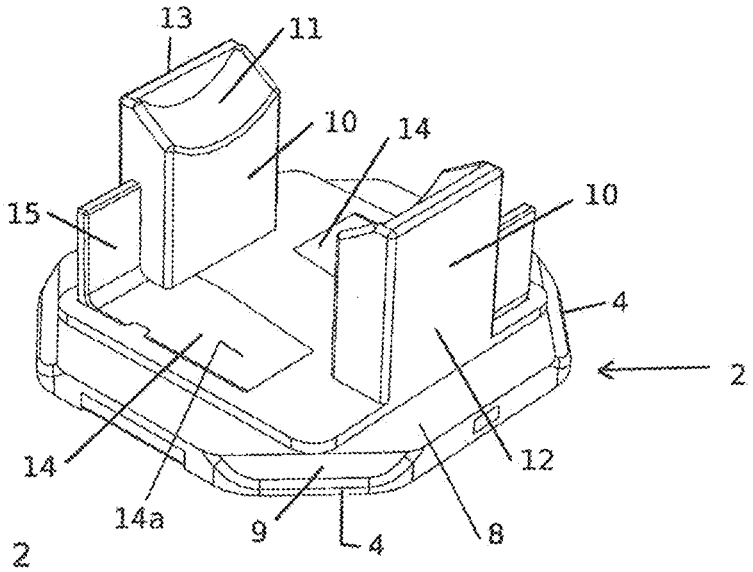
FIG. 2 shows a perspective plan view of a housing base.

FIG. 2 now shows the perspective plan view of a housing base 2. The inclined surfaces 4 already mentioned can also be seen here. It can be seen from FIG. 2 that the upper face 8, which is flat per se, of the housing base 2, in the region of the chamfered corners, has inclined surfaces 9 falling outwardly at an incline. These inclined surfaces 9 correspond in terms of their arrangement and size to the inclined surfaces 7 on the inner face of the protrusions 5 of the housing upper part 1.

Two bearing blocks 10 are integrally formed on the upper face 8 of the housing base 2 and have the form of a cuboid-shaped pillar having parallel side walls. The upper face of the bearing blocks 10 forms a cavity 11, which is delimited in each case by a rib 13 in the direction of the outer surfaces 12 facing away from one another. The inner face of the rib 13 is flat and runs parallel to the outer surface 12, which is also flat, of each bearing block 10.

As can also be deduced from the perspective illustration in FIG. 2, the cavities 11 run on the upper face of the bearing blocks 10 in a manner falling inwardly.

The solder pads 3 mentioned with reference to FIG. 1 continue on the upper face 8 of the housing base 2 into electrodes 14, which have a branch 14*a* resting on the upper face. In the region of the outer face, the electrode is bent upwardly and there forms a contact surface 15, which is flat and runs perpendicular to the upper face 8 of the housing base 2.

The extension pointing upwardly, that is to say away from the upper face 8 of the housing base 2, of the contact surface 15 of the electrodes 14 in the illustrated example reaches almost as far as the cavity 11 and may also be formed so as to be longer. This surface 15 is available for contacting with the ends of the coil winding.

Figure 4:
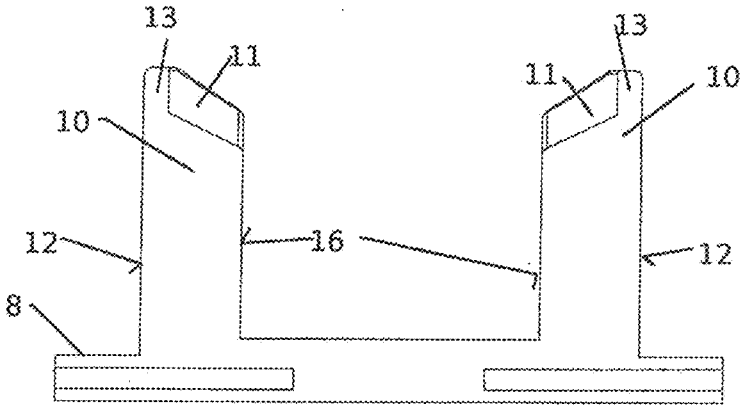
FIG. 4 shows a longitudinal section through the housing base.

A longitudinal section through the housing base 2 is illustrated in FIG. 4. Here, the mirrored arrangement of the two bearing blocks 10 can be seen in particular. Their outer faces 12 run perpendicular to the lower face of the housing base 2. The inner faces 16 also run perpendicular to the housing base 2 and therefore parallel to one another. Both bearing blocks 10 are of equal height.

The incline of the cavities 11 corresponds approximately to a bevel 17 at the end of a coil core 18, which belongs to the coil arranged in the induction component according to the invention.

Figure 5:
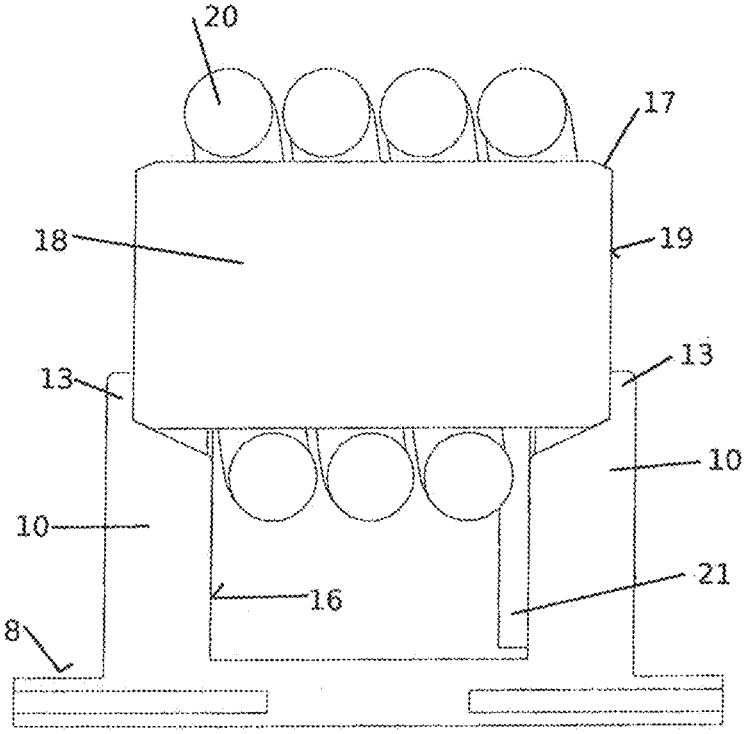
FIG. 5 shows a longitudinal section through the housing base with inserted coil core.

Whereas FIG. 4 shows the longitudinal section through the housing base 2, FIG. 5 shows an identical longitudinal section, wherein the coil however is now already inserted in the housing base 2. The coil contains a cylindrical coil core 18 having two flat end surfaces 19 running perpendicular to the longitudinal axis of the coil core 18 and therefore parallel to one another. The coil core 18 is surrounded by a coil winding 20. The coil winding 20 leaves free the two ends of the coil core 18, such that the coil core 18 can be inserted into the two bearing blocks 10. The bevel 17 rests in the cavities 11, and the end surfaces 19 bear against the inner face of the ribs 13. Since the curvature of the cavities 11 is adapted to the diameter of the coil core 18, the coil is therefore fixed both in the direction of its own axis and in the direction perpendicular to the drawing plane of FIG. 5. Once the housing upper part 1 has been slid onto the housing base 2, a defined, constant air gap thus exists between the two end faces 19 and the adjacent regions of the wall of the housing upper part 1.

The wire ends 21 of the coil winding 20 are guided downwardly in a straight line at the end of the coil winding and are welded to the contact surfaces 15 of the electrodes 14. This is indicated in FIG. 5 at the wire end 21 arranged behind the drawing plane.

Figure 6:
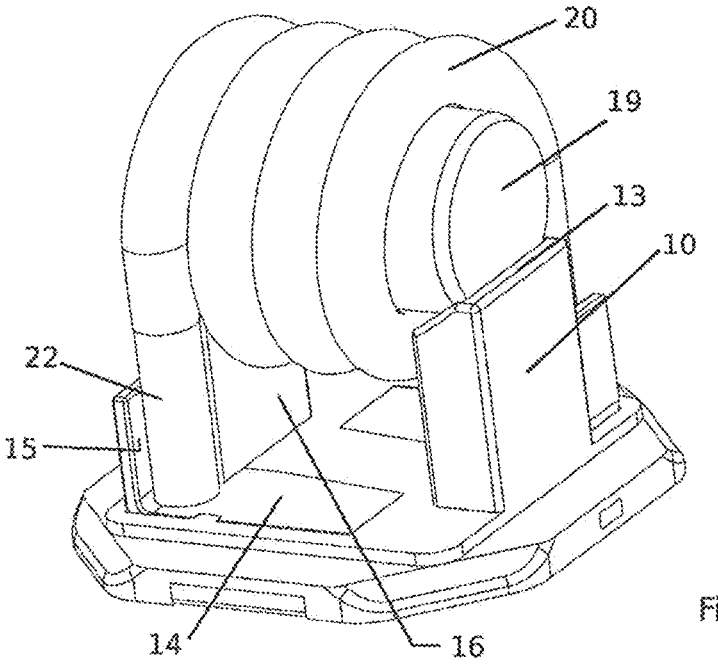
FIG. 6 shows a perspective view of the arrangement in FIG. 5.

FIG. 6 now shows a perspective view of the arrangement of the coil on the housing base 2. The front wire end 22 of the coil winding 20 is guided downward as far as the electrode 14 and is welded to the contact surface 15. The connection between the wire 22 and the contact surface 15 is thus formed on the lateral surface of the wire of the coil winding 20, said wire being cylindrical in the end region. By applying a holding force by the electrode holders, the wire ends are deformed elliptically. A tolerance gap is provided between the front wire end 22 and the branch 14*a* of the electrode 14 resting on the upper face of the housing base 2. It can also be deduced from FIG. 6 that the contact surface could be increased, by extending the electrode in a direction perpendicular to the housing base 2.

Figure 7:
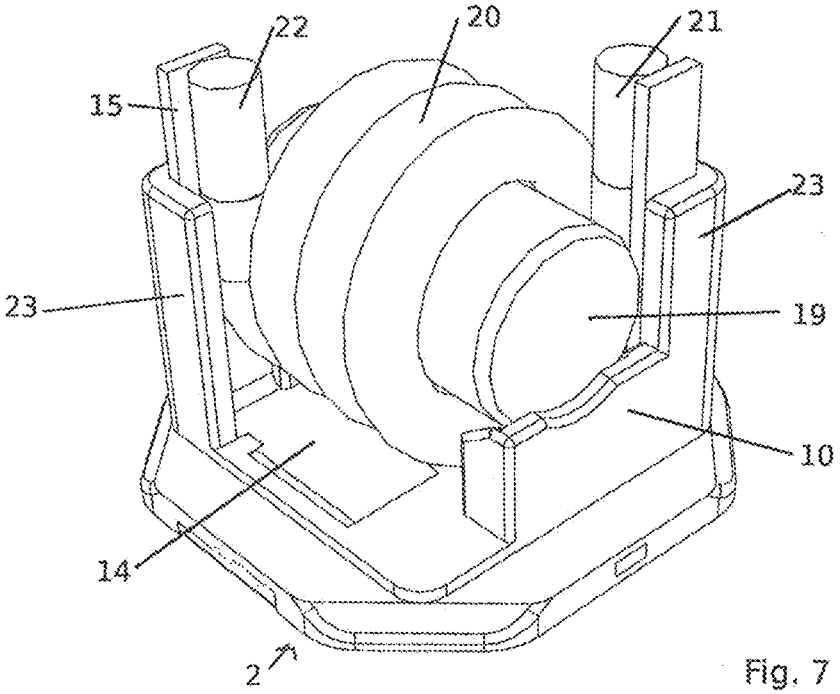
FIG. 7 shows an illustration, corresponding to FIG. 6, of a modified arrangement of a coil in the housing base.

FIG. 7 shows such a possibility, in which the upwardly directed parts of the electrodes are guided further upwardly with the contact surface 15 formed on its inner face. In addition, they are supported outwardly by corresponding angle supports 23, which are formed integrally with the bearing blocks 10. In this case, the wire ends 22, 21 can be directed upwardly.

By welding the wire ends 21, 22 to the contact surfaces 15 of the electrodes 14, the coil is therefore also fixed in the third dimension.

Once the wire ends 22 have been connected to the contact surfaces 15, the housing upper part 1, which was provided beforehand with glue at least on its end surfaces 6, is fitted onto the housing base 2. The inner face of the walls of the housing upper part 1 rest on the outer faces 12 of the bearing blocks 10. A gap thickness is thus defined which corresponds to the thickness of the ribs 13.

Due to the large contact surface between the contact surfaces 15 of the electrodes 14 and the wire ends 21, 22 of the coil winding 20, sufficiently large pull-out forces are enabled, such that the induction component forms a stable unit.

The invention claimed is:

1. An induction component, comprising a coil core (18) having a coil winding (20) and two end surfaces (19), a housing surrounding the coil, a holder for the coil core (18), said holder being arranged in the housing, having a bearing block (10) including a conical bearing rest for each respective end region of the coil core (18), the conical bearing rests each including an upwardly open cavity (11) having a curvature corresponding to the diameter of the coil core (18), and a rib (13) defining the conical bearing rest and engaging the end surface (19) of the coil core (18); and the coil core (18) being held in the holder non-displaceably in the longitudinal direction, and also comprising a distance, forming a gap, between the end surfaces (19) of the coil core (18) and the inner face of the housing in the region opposite the end surfaces (19) of the coil core (18).

2. The induction component as claimed in claim 1, wherein the outer face (12) of the bearing block (10) bears in a planar manner against the inner face of the housing.

3. The induction component as claimed in claim 1, wherein the housing has a hood-like upper part (1) with a housing base (2).

4. The induction component as claimed in claim 3, wherein the holder is arranged on the housing base (2), in particular is formed integrally on the housing base (2).

5. The induction component as claimed in claim 3, wherein the housing upper part (1) consists of magnetically conductive material and the housing base (2) consists of non-conductive material.

6. The induction component as claimed in claim 1, comprising electrodes (14) arranged on the inner face of the housing for connection to the ends (21, 22) of the coil winding (20).

7. The induction component as claimed in claim 6, wherein the electrodes run parallel to the walls of the housing and have a flat contact surface (15) for the end region of the coil winding, wherein the ends (21, 22) of the coil winding (20) are preferably welded via their lateral surfaces to the electrodes.

8. The induction component as claimed in claim 3, wherein the housing base (2) has a rectangular shape with chamfered corners and the housing upper part (1) has protrusions (5) on its end edge (6), said protrusions being formed in a manner complementary to these chamfered corners.

9. The induction component as claimed in claim 3, wherein the housing base (2), on its upper face (8) in the region of the chamfered corners, has inclined surfaces (9) falling outwardly, with which inclined surfaces (7) formed on the inner face of the protrusions (5) of the housing upper part (1) cooperate.

10. A method for installing an induction component as claimed in claim 1, comprising the following method steps:

a coil is wound and the wire ends (21, 22) are wetted with solder, the coil is slid onto the coil core (18), the coil core (18) is placed onto the bearing blocks (10), the ends of the coil winding (20) are welded to electrodes of the housing base (2), glue is injected into the housing upper part (1), the housing base (2) is connected to the upper part (1), the glue is left to cure.

* * * * *